US008695349B2

(12) United States Patent
Toon

(10) Patent No.: US 8,695,349 B2
(45) Date of Patent: Apr. 15, 2014

(54) FUEL INJECTOR FOR A GAS TURBINE ENGINE

(75) Inventor: Ian J. Toon, Leicester (GB)

(73) Assignee: Rolls-Royce PLC, London (GB)

( * ) Notice: Subject to any disclaimer, the term of this patent is extended or adjusted under 35 U.S.C. 154(b) by 485 days.

(21) Appl. No.: 12/785,707

(22) Filed: May 24, 2010

(65) Prior Publication Data

US 2010/0307159 A1 Dec. 9, 2010

(30) Foreign Application Priority Data

Jun. 3, 2009 (GB) ..... 0909493.9

(51) Int. Cl.
*F02C 1/00* (2006.01)
*F02G 3/00* (2006.01)

(52) U.S. Cl.
USPC ..... 60/740

(58) Field of Classification Search
USPC ..... 60/800, 737–748; 239/397.5, 451–460
See application file for complete search history.

(56) References Cited

U.S. PATENT DOCUMENTS 4,584,834 A * 4/1986 Koshoffer et al. ..... 60/737
5,372,008 A * 12/1994 Sood ..... 60/737
5,640,851 A * 6/1997 Toon et al. ..... 60/737
5,749,219 A * 5/1998 DuBell ..... 60/804
5,761,907 A * 6/1998 Pelletier et al. ..... 60/740
6,427,435 B1 * 8/2002 Patterson et al. ..... 60/800
7,107,773 B2 * 9/2006 Little ..... 60/773
8,015,816 B2 * 9/2011 Hall ..... 60/740
8,240,151 B2 * 8/2012 Pelletier et al. ..... 60/740
2002/0014079 A1 * 2/2002 Wrubel et al. ..... 60/740
2008/0053062 A1 3/2008 Tuttle

OTHER PUBLICATIONS

Great Britain Search Report issued in Great Britain Patent Application No. 0909493.9 issued on Oct. 5, 2009.

* cited by examiner

*Primary Examiner* — Phutthiwat Wongwian
*Assistant Examiner* — William Breazeal
(74) *Attorney, Agent, or Firm* — Oliff PLC

(57) ABSTRACT

An improved fuel spray nozzle for a gas turbine engine is proposed, in order to address problems associated with the nozzles being wetted with fuel purged from fuel lines upon engine shutdown. The nozzle has a heat shield provided around a fuel discharge orifice, the heat shield incorporating a sliding expansion joint and having a drip collar arranged to cover the expansion joint so as to protect it from being wetted by fuel ejected through the fuel discharge orifice and falling on the heat shield. The fuel spray nozzle is particularly suited to marine or industrial gas turbine engines having a plurality of radially oriented combustion chambers with respective fuel spray nozzles.

17 Claims, 7 Drawing Sheets

FUEL INJECTOR FOR A GAS TURBINE ENGINE

The present invention relates to gas turbine engines. More particularly, the invention relates to fuel injectors for gas turbine engines.

Gas turbine engines designed for marine or industrial use typically incorporate a multiple combustion chamber system which is made up of a series of individual combustion chambers positioned around the engine. Each chamber has an inner flame tube with its own air casing. Ducts direct air from the compressor of the engine into each chamber. The air passes through the flame tube snout and also between the tube and the outer air casing. The separate flame tubes are generally all interconnected, thereby allowing combustion to propagate around the flame tubes during engine starting, and also ensuring that the tubes all operate at the same pressure.

Marine and industrial gas turbine engines using multiple combustion chambers of the type indicated above are generally configured such that the individual chambers are arranged perpendicular to the engine's centreline, in an annular array. As will be appreciated, in marine and industrial applications space is less of a concern than in typical aero applications and this architecture makes it easy to conduct maintenance work on the combustors, whilst also accommodating larger combustors than in alternative arrangements commonly used in aero applications.

As will thus be appreciated, typical marine or industrial gas turbine engines incorporate a plurality of generally tubular combustors arranged radially around the engine's centreline and equi-spaced from one another. Each combustor incorporates a discharge nozzle arranged to turn the combustor outlet flow through approximately 90 degrees such that the combustor outlet flow is directed into the downstream turbine in a direction generally parallel to the rotational axis of the engine. Each combustor incorporates a fuel injector, such as a fuel spray nozzle, which fits into the outboard end of the combustor so as to direct a spray of fuel generally radially inwardly towards the rotational axis of the engine. As will thus be appreciated, a gas turbine engine with the aforementioned combustion chamber arrangement will incorporate a number of fuel injectors in the upper region of the engine which point generally downwardly towards the rotational axis of the engine, and a number of fuel injectors in the lower region of the engine which point generally upwardly towards the rotational of the engine.

When an operating gas turbine engine is shut down by stopping the flow of fuel through the fuel injectors, it is necessary to remove all of the fuel from the internal fuel passages of the fuel injectors. This is because at the instant of engine shutdown the temperature of the gases supplied to the combustion equipment from the upstream compressor are extremely high, and typically in excess of 800 degrees Kelvin. Temperatures at this level are effective to breakdown any static fuel remaining in the internal passages of the fuel injectors, resulting in the creation of carbon deposits and lacquer which can build up over time and block the fuel passages and cause subsequent malfunction of the combustion equipment. To prevent the build up of carbon in this manner, it is therefore conventional practice to purge the fuel passages of the fuel injectors with air after engine shutdown until such time as the engine temperature falls to a level which will not cause fuel breakdown.

Fuel purged from the downwardly directed fuel injectors in the upper part of the engine will be sprayed generally downwardly and hence away from the fuel injectors, and so will not wet the outside of the fuel injectors. However, fuel purged from the upwardly directed fuel injectors in the lower region of the engine is sprayed upwardly, and so when the fuel droplets subsequently fall under gravity they will wet the outside of the fuel injectors.

FIG. 1 shows the configuration of a previously proposed fuel injector of a fuel spray nozzle type. The nozzle has a central axis 1 and is generally circularly symmetrical about this axis. The main body part 2 of the nozzle has an outwardly directed mounting flange 3 and contains a fuel supply pipe 4 that is connected to and hence feeds fuel into an inlet 5 provided in the head region 6 of the nozzle. The fuel discharge orifice 8 is provided around a central air flow passage 9 which is fed with a flow of air from an air inlet opening 10. Fuel is discharged through orifice 8 where an annular film of liquid fuel is formed which is entrained in and atomised by a rapidly moving flow of air exiting the air flow passage 9.

The head region 6 of the nozzle incorporates a generally conical heat shield 11 which extends from the extreme tip of the nozzle generally around the discharge orifice to a region spaced outwardly from the tip. The heat shield is configured to protect the structure of the nozzle head 6 from the extreme temperatures to which the nozzle is subjected. The heat shield 11 incorporates a sliding expansion joint 12 formed between a first head shield member 13 at the extreme tip of the nozzle and a second heat shield member 14. As will be appreciated, the sliding expansion joint 12 is provided to permit relative movement between the first and second heat shield members in order to accommodate thermal expansion and contraction of the heat shield 11.

When the outer surface of the heat shield 11 becomes wetted with fuel droplets purged from the fuel injector discharge orifice 8, the fuel droplets falling on the first heat shield member 13 will drain downwardly from the nozzle tip and onto the sliding expansion joint 12. Fuel can then pass through the sliding joint by capillary action and into the cavity 15 defined between the heat shield 11 and the inner fuel supply structure of the nozzle. During subsequent operation of the engine, any fuel present in the cavity 15 will break down to carbon when the air in the cavity becomes hot. Eventually, over the course of time, the deposited carbon will fill the cavity 15, thereby causing mechanical failure of the fuel supply nozzle and possible failure of the sliding expansion joint 12. Additionally, the presence of carbon deposits inside the cavity 15 increases the conduction of heat from the heat shield 11 to the inner fuel containing internal structure of the nozzle, thereby causing higher fuel temperatures in the fuel passages, which in turn results in the further breakdown of fuel in those passages causing more carbon deposits which can potentially block the fuel passages causing a combustor malfunction and engine damage.

As will be appreciated, the prior art nozzle structure illustrated in FIG. 1 incorporates a sliding expansion joint 12 configured such that the second heat shield member 14 slidingly engages around the outside of the first heat shield member 13. This arrangement is particularly susceptible to the above-mentioned problems because the sliding interface between the two heat shield members is directly exposed to the fuel droplets falling on the heat shield. However, FIG. 2 illustrates an alternative configuration of prior art nozzle in which the sliding expansion joint 12 has a reversed configuration such that the first radially innermost heat shield member 13 is slidingly engaged around the outside of a region 16 of the second heat shield member 14. Although this arrangement is effective to protect the sliding interface between the first and second heat shield members from direct exposure to fuel droplets draining downwardly from the first heat shield member 13 by gravity, it has been found that fuel can still be drawn through the expansion joint 12 by capillary action, thereby causing similar problems to those indicated above in the context of the prior art arrangement of FIG. 1.

It is therefore an object of the present invention to provide an improved fuel injector for a gas turbine engine.

Accordingly, a first aspect of the present invention provides a fuel injector for a gas turbine engine, the injector having a heat shield provided around a fuel discharge orifice, the heat shield incorporating a sliding expansion joint and having a drip guard arranged to cover the expansion joint so as to protect it from being wetted by fuel ejected through the fuel discharge orifice and falling on the heat shield. The drip guard preferably takes the form of a collar.

The fuel injector is preferably provided in the form of a fuel spray nozzle.

Preferably, the heat shield comprises first and second members slidingly engaged with one another so as to define said expansion joint, with the drip guard being provided on the first member and being arranged to overlie a region of the second member.

In preferred embodiments of the invention, the drip guard is spaced from said region of the second member.

The drip guard is preferably formed as an integral part of the first member.

The fuel discharge orifice may be provided through the first heat shield member, and the second heat shield member may be spaced from the fuel discharge orifice.

In proposed embodiments of the invention, the second heat shield member may be substantially frustoconical in form. In the case of such an arrangement, the drip guard may be substantially frustoconical in form and arranged so as to be concentric around at least a region of the second heat shield member.

In alternative embodiments of the invention, the second heat shield member may be substantially cylindrical in form. In the case of such an arrangement, the drip guard may be substantially cylindrical in form and arranged so as to be concentric around at least a region of the second heat shield member.

According to a second aspect of the present invention, there is provided a gas turbine engine having at least one fuel injector according to the first aspect.

According to a third aspect of the present invention, there is provided a gas turbine engine having a plurality of fuel injectors arranged substantially radially around the rotational axis of the engine so as to direct respective sprays of fuel substantially radially inwardly towards said axis, wherein at least the or each fuel injector in a lower region of the engine is configured according to the first aspect.

The gas turbine engine of either the second or third aspects of the invention is preferably a marine engine. Alternatively, however, the gas turbine engine may be configured for industrial use in the generation of electrical power.

So that the invention may be more readily understood, and so that further features thereof may be appreciated, embodiments of the invention will now be described by way of example with reference to the accompanying drawings in which.

Figure 1:
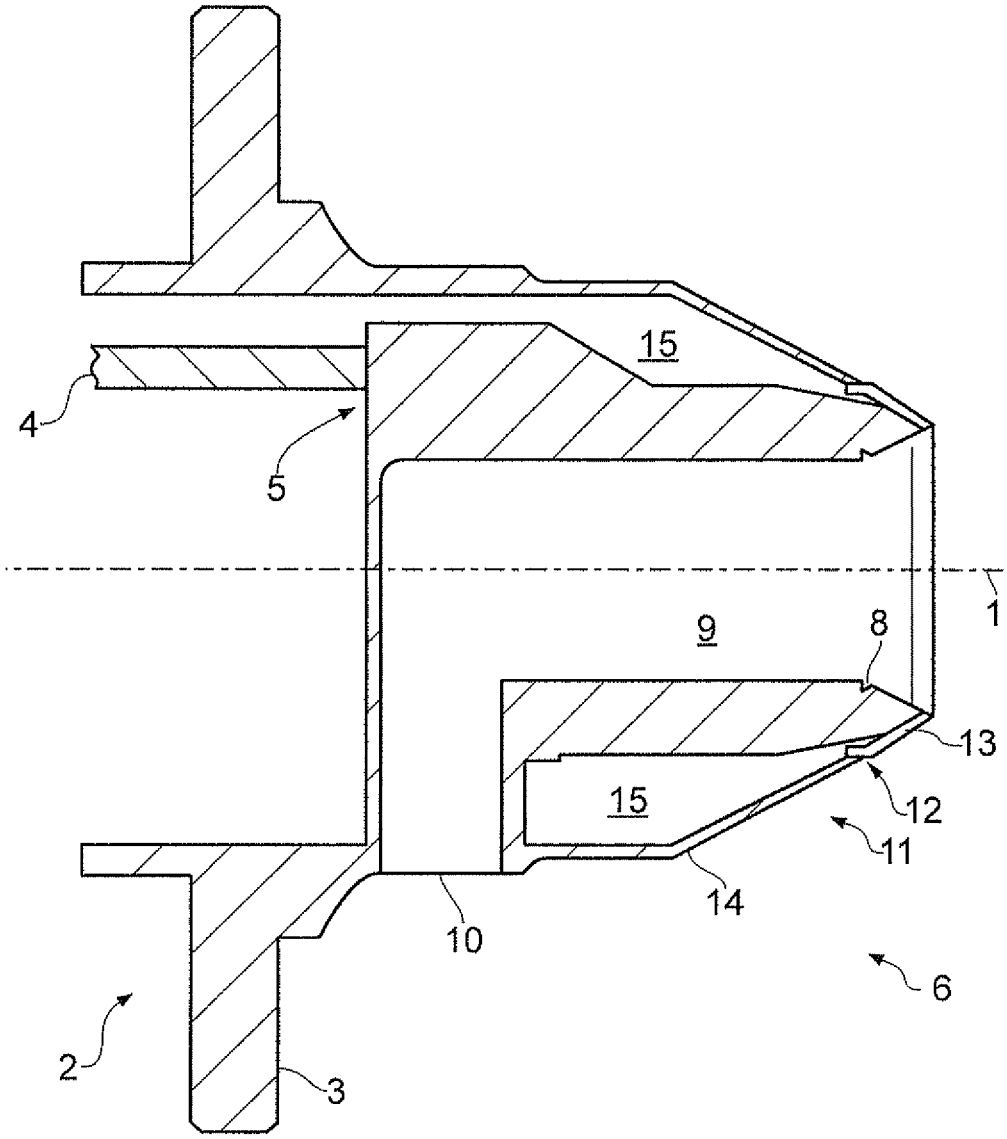
FIG. 1 is a cross-sectional view showing a conventional fuel spray nozzle of the prior art.
Figure 2:
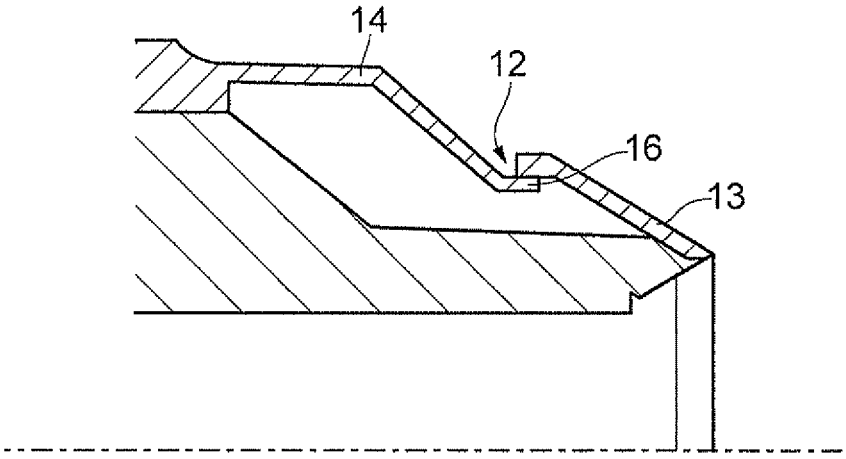
FIG. 2 is a cross-sectional view showing an alternative prior art fuel spray nozzle.
Figure 3:
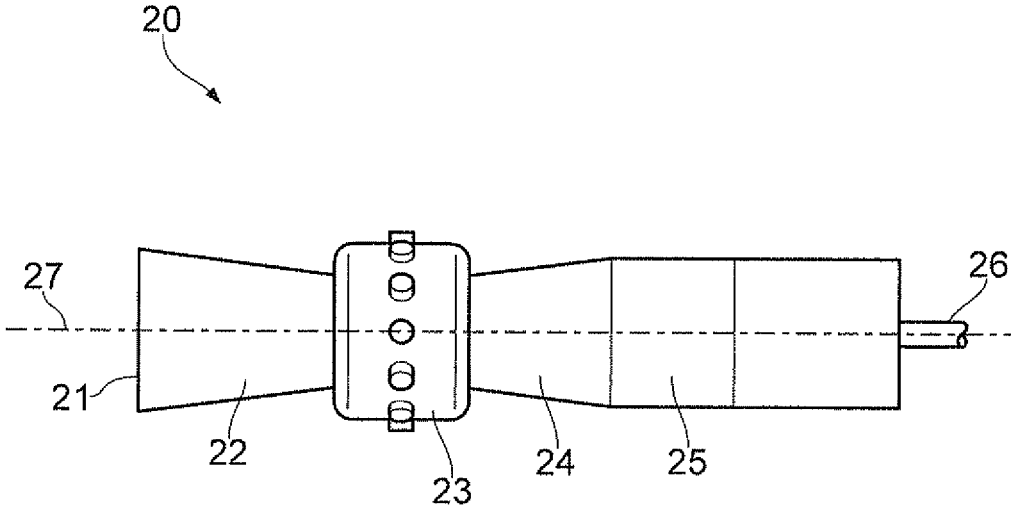
FIG. 3 is a schematic illustration showing a gas turbine engine suitable for marine or industrial use.

Turning now to consider FIG. 3, there is illustrated a gas turbine engine 20 having a configuration suitable for use in marine and/or industrial applications. In a generally conventional manner the gas turbine engine includes, in axial flow series, an air intake 21, a compressor 22, combustion equipment 23 and a turbine 24. The compressor 22 and the turbine 24 are interconnected by a central shaft (not shown). The engine operates in a generally conventional manner such that air is drawn into the engine through the air intake 21 and is directed towards the compressor 22 where the air is compressed and then mixed with fuel which is burned in the combustion equipment 23 located downstream of the compressor, thereby producing a flow of hot compressed gas. The hot compressed gas is then directed into the turbine 24 where the hot gas expands through, and thereby drives the turbine which, by virtue of the interconnecting shaft, is effective to drive the compressor 22. The exhaust gases from the engine are directed into and drive a power turbine 25 which is arranged downstream of the turbine 24 and which, in turn, drives a power output shaft 26.

Figure 4:
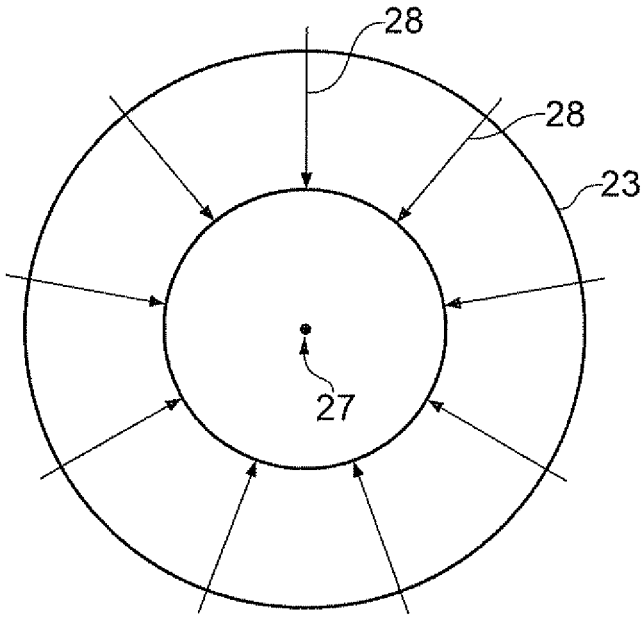
FIG. 4 is a schematic illustration, in transverse cross-section, showing the orientation of an annular array of fuel spray nozzles provided as part of the combustion equipment of the engine shown in FIG. 3.

The combustion equipment 23 consists of a plurality of generally tubular combustors arranged in a radial array around the rotational axis 27 of the engine. As will thus be appreciated, and as illustrated schematically in FIG. 4, each combustor has a respective centreline 28 which is directed radially inwardly towards and is generally orthogonal with the rotational axis 27 of the engine. Each combustor is associated with a respective fuel injector which fits into the outboard end of the combustor in order to direct respective sprays of fuel radially inwardly towards the rotational axis 27 of the engine along the centrelines 28 illustrated in FIG. 4.

Figure 5:
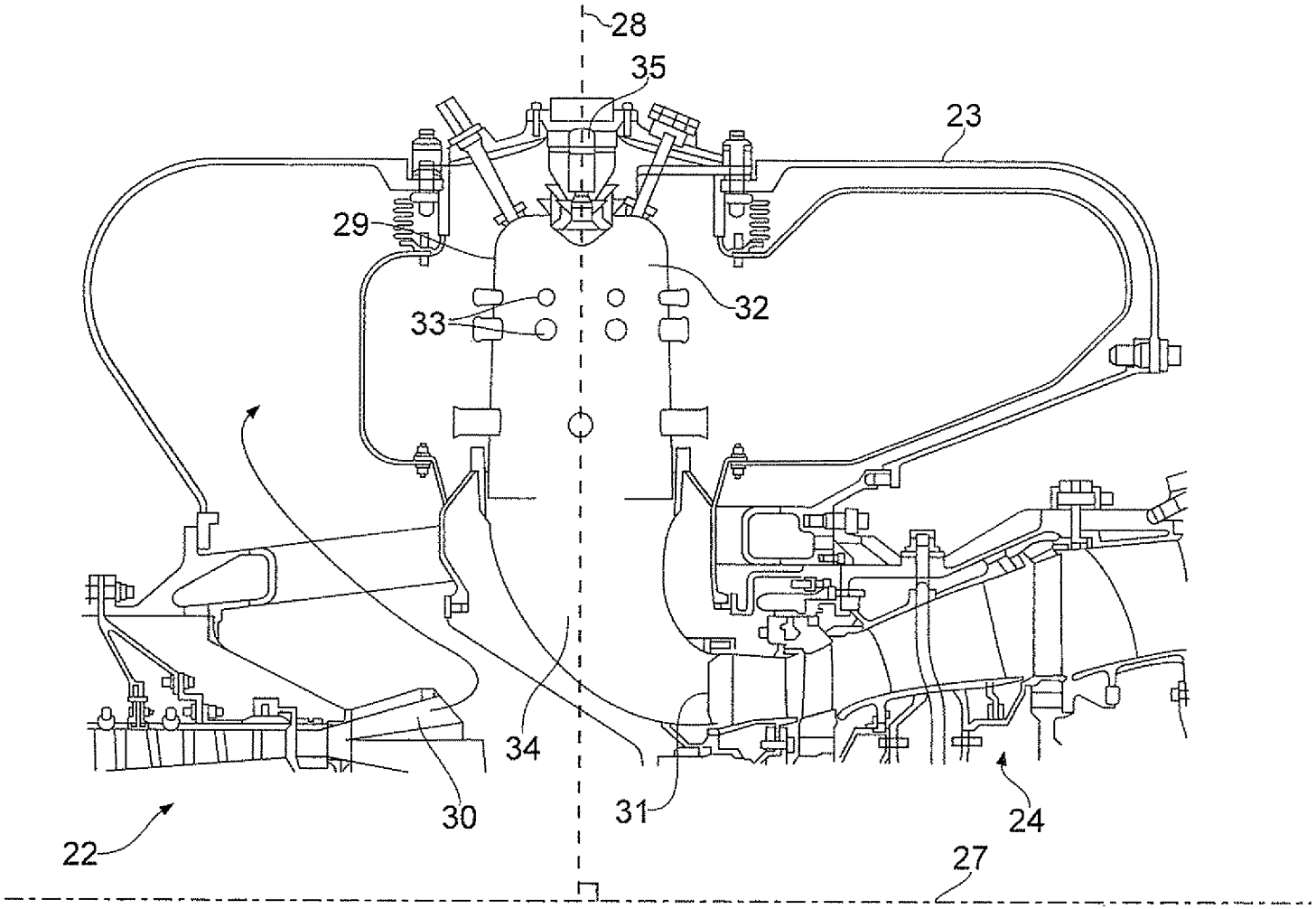
FIG. 5 is a radial cross-sectional view showing the arrangement of an individual combustor.

FIG. 5 illustrates the general arrangement of an individual combustor 29 in further detail. The combustor 29 is housed within the outer casing 23 between the outlet diffuser 30 of the compressor 22 and the inlet 31 of the turbine 24. The combustor 29 comprises a generally cylindrical combustion chamber 32 having a number of air inlet apertures 33 through which compressed air directed towards the combustion chamber 32 from the diffuser outlet 30 passes into the interior volume of the combustion chamber 32. The radially inner end of the combustion chamber 32 is fluidly connected to the annular turbine inlet 31 via a curved discharge nozzle 34 which is shaped and configured to turn the flow of combustion gases exiting the combustion chamber 32 through approximately 90 degrees so that they enter the turbine in a direction generally parallel to the rotational axis 27 of the engine.

At the radially outermost end of the combustor 29, a fuel injector 35 is provided, the head of which extends into the radially outer region of the combustion chamber 32. The fuel injector 35 preferably takes the form of a fuel spray nozzle and is arranged so as to be generally aligned with the centreline 28 of the combustor so as to direct a spray of fuel generally radially inwardly towards the rotational axis 27 of the engine.

As will be appreciated, the combustor 29 and associated fuel spray nozzle 35 illustrated in FIG. 5 is provided in the upper region of the engine so as to be located above the rotational axis 27. Accordingly, the fuel spray nozzle 35 points generally downwardly and so when purged with air upon engine shut down, the fuel blown out of the fuel lines will fall away from the fuel spray nozzle under the effect of gravity. The present invention is particularly intended to address the aforementioned problems associated with fuel spray nozzles in the lower region of the engine, i.e. generally below the rotational axis 27, which are thus directed generally upwardly and which, when purged with air upon engine shutdown, tend to become wetted by the purged fuel falling back onto the fuel spray nozzle under gravity.

Figure 6:
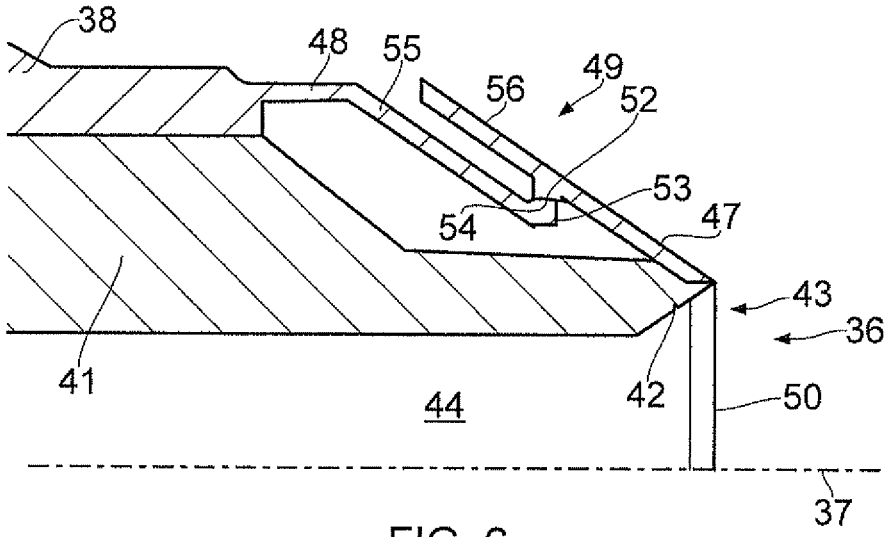
FIG. 6 is a cross-sectional view showing the arrangement of a fuel spray nozzle in accordance with a second aspect of the present invention.

Turning now to consider FIG. 6, there is illustrated a fuel injector 36 in accordance with the first embodiment of the present invention and which is shown in the form of a fuel spray nozzle. The fuel spray nozzle is shown in an is orientation in which it is directed upwardly, as would be the case when it is installed in the lower region of an engine.

In a generally conventional manner, the nozzle is circularly symmetrical about a central axis 37 and has a body part 38. Fuel exits the injector through a narrow fuel discharge orifice 42 of annular configuration in the region of the tip 43 of the nozzle head. A relatively large bore air flow passage 44, centred on the axis 37 extends inside the injector body 41 and is fed with a flow of air from an air inlet passage. As will be appreciated, as thus-far described the fuel spray nozzle 36 is generally conventional.

The fuel spray nozzle 36 additionally incorporates a heat shield indicated generally at 46 and which is configured so as to protect the internal structure and flow passages of the nozzle head from the very high temperatures experienced within the combustor 29. In the particular arrangement illustrated in FIG. 6 the heat shield 46 comprises two discreet members 47, 48 which are arranged to bear against each other in a sliding manner in order to define a sliding expansion joint indicated generally at 49. The first heat shield member 47 is generally frustoconical in form and is arranged so as to taper outwardly from the central axis 37 with increasing radial distance outwardly from the tip 43 of the nozzle. The fuel outlet orifice 42 is provided slightly behind a relatively large central opening 50 defined through the narrow end of the first heat shield member 47.

In the region of the expansion joint 49, the first heat shield member 47 is provided with an inwardly directed shoulder 51 which defines a generally cylindrical sliding is surface 52 forming part of the expansion joint 49.

The second heat shield member 48 is spaced radially outwardly from the fuel discharge orifice and is also of generally frustoconical form, being circularly symmetrical about the central axis 37 and concentric with the first heat shield member 47. The second heat shield member 48 has a short, generally cylindrical lip 53 at its radially outermost end which defines an outwardly-directed sliding surface 54 which bears against the sliding surface 52 of the first member 47 for sliding movement relative thereto. From the radially innermost lip 53, the second heat shield member 48 has a region 55 which tapers outwardly so as to be generally parallel to the first heat shield member 47.

As also illustrated in FIG. 6, the widest radially outer region of the first heat shield member 47 defines a collar or skirt 56 which is arranged so as to cover the sliding expansion joint 49 and to overlie the tapering region 55 of the second heat shield member 48. The collar or skirt 56 thus serves as a drip guard which is configured to protect the underlying sliding expansion joint 49 from being wetted by fuel ejected through the fuel outlet orifice 42 when the fuel supply lines are purged with air. Any fuel droplets purged from the fuel supply lines and forced outwardly and upwardly from the fuel outlet orifice 42 will thus fall on the first heat shield member 47 under the effect of gravity and will then drip or run down the collar or skirt 56, thereby remaining clear of the sliding expansion joint 49. The heat shield structure described above and illustrated in FIG. 6 is thus effective in the case of upwardly directed fuel spray nozzles 36 such as that illustrated in FIG. 6, to prevent fuel purged from the fuel supply lines from penetrating the expansion joint is 49, even by capillary action.

Figure 7:
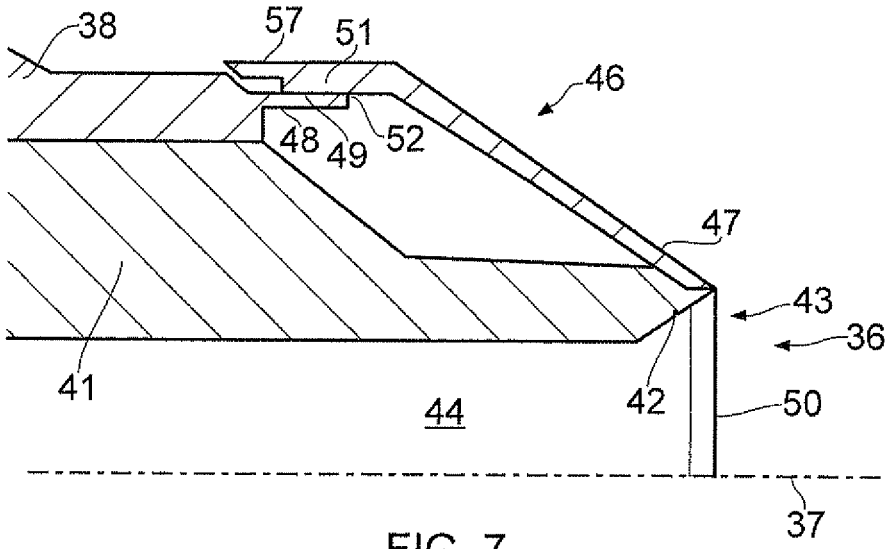
FIG. 7 is a cross-sectional view showing the arrangement of a fuel spray nozzle in accordance with a second embodiment of the present invention.

Turning now to consider FIG. 7, there is illustrated an alternative embodiment of the present invention in the form of a fuel injector such as a fuel spray nozzle. In many respects, the fuel spray nozzle configuration illustrated in FIG. 7 is generally identical to that illustrated in FIG. 6 and so for the sake of convenience the same reference numerals have been used to denote similar or equivalent parts as appropriate.

As will be noted, the principle difference between the fuel spray nozzle illustrated in FIG. 7 and the fuel spray nozzle illustrated in FIG. 6 is in respect of the configuration of the heat shield, indicated generally at 46. In the arrangement of FIG. 7, it will be noted that the second heat shield member 48 is significantly shorter, and rather than being frustoconical in form is instead substantially cylindrical in form. The first heat shield member 47 is also different in configuration, and in the arrangement of FIG. 7 is configured so as to be generally frustoconical in form but having a generally cylindrical skirt or collar 57 at its widest and radially outermost end. The skirt or collar 57 is configured so as to be circularly symmetrical about the central axis 37 and is arranged concentrically outside the cylindrical second heat shield member 48. An inwardly directed shoulder 51 is again formed on the first heat shield member 47, in the region of the transition between the main frustoconical region and the cylindrical skirt or collar 57. The shoulder 51 again defines an inwardly directed sliding surface 52 which is arranged to engage the outer surface of the cylindrical second heat shield member 48 in a sliding and sealing manner.

The cylindrical skirt or collar 57 of the first heat shield member 47 again serves as a drip guard which is arranged so as to cover and protect the sliding expansion joint 49 from being wetted from fuel purged from the fuel lines and hence ejected from the fuel outlet orifice 42. Fuel droplets purged from an upwardly directed nozzle (as illustrated in FIG. 7) in this manner will subsequently fall onto the frustoconical region of the first heat shield member 47 and will then run or drip down the outer surface of the first heat shield member 47. However, the presence of the drip guard as defined by the skirt or collar 57 is effective to prevent any of the fuel droplets from impinging on the expansion joint 49 and hence prevents fuel from penetrating the expansion joint, even under capillary action.

The fuel injector of the present invention, such as the embodiments illustrated in FIGS. 6 and 7, is particularly suitable for use in the lower region of a gas turbine engine such that the injector is oriented so as to inject fuel into the combustor 29 in a generally upwards direction, because it is fuel injectors provided in the lower region of the engine and in an upwardly directed orientation that are particularly susceptible to the aforementioned problems associated with purged fuel droplets. It is therefore proposed to provide a gas turbine engine with a plurality of fuel injectors arranged generally radially around the rotational axis of the engine so as to direct respective sprays of fuel substantially radially inwardly towards the rotational axis of the engine, wherein at least the fuel injectors in the lower region of the engine are configured in accordance with the above-mentioned proposals. However, it is envisaged that generally the gas turbine engine will be configured such that all of the fuel injectors are of generally similar configuration such that the injectors also in the upper region of the engine will have the same configuration.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

The exemplary embodiments of the invention set forth above are considered to be illustrative and not limiting.

The invention claimed is:

1. A fuel injector for a gas turbine engine, the fuel injector comprising:

an axis, an airflow passage;

a fuel discharge orifice;

an injector body; and a heat shield provided around the injector body, the heat shield including in axial series: a first member and a second member having respective sliding surfaces in contact with one another to provide a sliding expansion joint;

the first member being attached at an axially forward end to the injector body and including an axially rearward continuation spaced from the second member and continuing axially aft of the sliding expansion joint to provide a drip guard configured to cover at least a region of the expansion joint such that the sliding expansion joint is not substantially wetted by fuel ejected through the fuel discharge orifice and falling on the heat shield.

2. The fuel injector according to claim 1, wherein the drip guard is configured into the form of a collar.

3. A fuel injector according to claim 1, wherein the fuel discharge orifice is provided in the injector body, and wherein the first member and the second member are spaced from the injector body.

4. The fuel injector according to claim 1, wherein a form of the second member is substantially frustoconical.

5. The fuel injector according to claim 4, wherein a form of the drip guard is substantially frustoconical and is arranged so as to be concentric around at least a region of the second member.

6. The fuel injector according to claim 1, wherein a form of the second member is substantially cylindrical.

7. The fuel injector according to claim 1, wherein the fuel injector is provided in the form of a fuel spray nozzle.

8. A gas turbine engine having at least one fuel injector according to claim 1.

9. A gas turbine engine having a plurality of fuel injectors arranged substantially radially around the rotational axis of the engine so as to direct respective sprays of fuel substantially radially inwardly towards said axis, wherein at least the fuel injector positioned in a lower region of the engine is configured according to claim 1.

10. The fuel injector according to claim 3, wherein the heat shield is spaced from the injector to define an enclosed volume between the heat shield and the injector body.

11. The fuel injector according to claim 1, wherein the drip guard lies radially outside the sliding expansion joint.

12. The fuel injector according to claim 1, wherein the drip guard is oriented towards an upstream end of the airflow passage.

13. The fuel injector according to claim 12, wherein the drip guard is configured into the form of a collar.

14. The fuel injector for a gas turbine according to claim 12, wherein the drip guard is provided on the first member and is arranged to overlie a region of the second member.

15. The fuel injector according to claim 12, wherein the fuel injector is provided in the form of a fuel spray nozzle.

16. A gas turbine engine having at least one fuel injector according to claim 12.

17. A fuel injector for a gas turbine engine, the fuel injector comprising:

a central axis;

an airflow passage extending longitudinally along the central axis;

an injector body circumscribing the airflow passage;

a fuel discharge orifice;

a heat shield comprising a first member, a second member, and a fuel drip guard;

the drip guard being an upstream continuation of the first member;

the continuation comprising a joint between a downstream end of the drip guard and an upstream end of the first member;

the continuation having a sliding surface in contact with a downstream end of the second member;

the upstream end of the second member being attached at a radially outward and upstream end to the injector body;

the drip guard having an upstream free end;

the drip guard and the second member defining an open cavity therebetween.

* * * * *